US006405427B2

(12) United States Patent
Kummer

(10) Patent No.: US 6,405,427 B2
(45) Date of Patent: Jun. 18, 2002

(54) METHOD OF MAKING A SOLENOID ACTUATED FUEL INJECTOR

(75) Inventor: Philip A. Kummer, Hampton, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/785,495

(22) Filed: Feb. 20, 2001

Related U.S. Application Data

(62) Division of application No. 09/233,714, filed on Jan. 19, 1999.

(51) Int. Cl.[7] ..... H01F 41/00

(52) U.S. Cl. ..... 29/606; 29/602.1; 239/585.1; 251/129.21

(58) Field of Search ..... 29/602.1, 606; 239/585.1, 585.2, 585.3, 585.4, 585.5, 600; 251/129.21

(56) References Cited

U.S. PATENT DOCUMENTS

| | | | | |
|---|---|---|---|---|
| 4,342,427 | A | 8/1982 | Gray | 239/585 |
| 4,915,350 | A | 4/1990 | Babitzka et al. | 251/129.15 |
| 4,984,744 | A | 1/1991 | Babitzka et al. | 239/585 |
| 5,054,691 | A | 10/1991 | Huang et al. | 239/585 |
| 5,076,499 | A | 12/1991 | Cranford | 239/585 |
| 5,211,341 | A | 5/1993 | Wieczorek | 239/585.3 |
| 5,236,174 | A | 8/1993 | Vogt et al. | 251/129.21 |
| 5,275,341 | A | 1/1994 | Romann et al. | 239/585.4 |
| 5,340,032 | A | 8/1994 | Stegmaier et al. | 239/575 |
| 5,494,224 | A | 2/1996 | Hall et al. | 239/585.5 |
| 5,494,225 | A | 2/1996 | Nally et al. | 239/585.5 |
| 5,566,920 | A | 10/1996 | Romann et al. | 251/129.21 |
| 5,580,001 | A | 12/1996 | Romann et al. | 239/585.4 |
| 5,692,723 | A | 12/1997 | Baxter et al. | 251/129.21 |
| 5,718,387 | A | 2/1998 | Awarzamani et al. | 239/585.1 |
| 5,732,888 | A | 3/1998 | Maier et al. | 239/585.1 |
| 5,755,386 | A | 5/1998 | Lavan et al. | 239/585.4 |
| 5,769,965 | A | 6/1998 | Liedtke et al. | 148/121 |
| 5,775,600 | A | 7/1998 | Wildeson et al. | 239/585.4 |
| 5,875,975 | A | 3/1999 | Reiter et al. | 239/585.1 |
| 5,915,626 | A | 6/1999 | Awarzamani et al. | 239/135 |
| 5,927,613 | A | 7/1999 | Koyanagi et al. | 239/585.1 |
| 5,937,887 | A | 8/1999 | Baxter et al. | 137/15 |
| 5,975,436 | A | 11/1999 | Reiter et al. | 239/585.1 |
| 5,979,866 | A | 11/1999 | Baxter et al. | 251/129.21 |
| 5,996,227 | A | 12/1999 | Reiter et al. | 29/888.45 |
| 5,996,910 | A | 12/1999 | Takeda et al. | 239/585.1 |
| 5,996,911 | A | 12/1999 | Gesk et al. | 239/585.1 |
| 6,003,790 | A | 12/1999 | Fly | 239/533.9 |
| 6,012,655 | A | 1/2000 | Maier | 239/585.4 |
| 6,019,128 | A | 2/2000 | Reiter | 137/549 |
| 6,027,049 | A | 2/2000 | Stier | 239/585.1 |
| 6,039,271 | A | 3/2000 | Reiter | 239/585.4 |
| 6,047,907 | A | 4/2000 | Hornby | 239/585.1 |
| 6,076,802 | A | 6/2000 | Maier | 251/129.21 |
| 6,079,642 | A | 6/2000 | Maier | 239/585.1 |
| 6,089,475 | A | 7/2000 | Reiter et al. | 239/585.1 |
| 6,186,472 | B1 | 2/2001 | Reiter | 251/129.21 |
| 6,201,461 | B1 | 3/2001 | Eichendorf et al. | 335/256 |

*Primary Examiner*—Carl E. Hall

(57) ABSTRACT

A solenoid actuated fuel injector for use with an internal combustion engine includes a hydraulic metering subassembly and a power group subassembly. The hydraulic metering subassembly includes a fuel path and an armature/needle assembly movable between valve closed and open positions and calibrated independent of the power group subassembly to meter the discharge of fuel from the injector. The power group subassembly provides a magnetic flux return path and electromagnetic forces that move the armature/needle assembly between the valve closed and open positions. By providing an independently operational, calibrated hydraulic subassembly, a variety of different types of power group subassemblies may be used with the hydraulic metering subassembly resulting in design flexibility and a manufacturing process that is more flexible and cost efficient.

5 Claims, 3 Drawing Sheets

METHOD OF MAKING A SOLENOID ACTUATED FUEL INJECTOR

This is a divisional of application Ser. No. 09/233,714 filed on Jan. 19, 1999.

FIELD OF THE INVENTION

This invention relates to solenoid operated fuel injectors that are used in fuel injection systems of internal combustion engines and, in particular, to fuel injectors having two independent subassemblies.

BACKGROUND OF THE INVENTION

It is known in the art relating to fuel injectors for internal combustion engines to assemble a valve group subassembly and a power group subassembly, which are then assembled together. After final assembly, the coil associated with the power group subassembly, and now part of the injector, is energized and used to calibrate the assembled injector. Such an injector assembly is limited to a specific power group subassembly because that power group subassembly was used to calibrate the injector.

SUMMARY OF THE INVENTION

The present invention provides a solenoid actuated fuel injector that is not limited to use with a specific power group subassembly. More specifically, the injector of the present invention is comprised of an independently operational and calibrated hydraulic metering subassembly and an independent power group subassembly, making it possible to use the hydraulic metering assembly with any of a variety of power group subassemblies.

As hereinafter more fully described, a master coil associated with a test unit is used to calibrate the fuel metering subassembly instead of calibrating the injector using its own coil or power group subassembly. As such, the power group subassembly can be added at a later time to the hydraulic metering subassembly to make a complete working injector. Therefore, by having two independent subassemblies, costly production operations are eliminated, particularly in the area of tooling and changeovers for electrical connector variations.

A method of making the solenoid actuated fuel injector includes assembling a hydraulic metering subassembly having an armature/needle assembly movable between open and closed positions to meter the discharge of fuel from the injector. The hydraulic metering subassembly is calibrated with a master coil associated with a test unit. Then, the power group subassembly having an actuating coil and a magnetic flux return path is assembled. Finally, the two subassemblies are mechanically connected together such that a magnetic circuit is completed between the subassemblies to operate the armature/needle assembly between open and closed positions upon energizing and deenergizing of the coil.

As stated, the fuel injector of the present invention includes a hydraulic metering subassembly and a power group subassembly. The hydraulic metering subassembly has an elongated ferromagnetic inlet tube for conveying fuel from a fuel inlet to a fuel outlet. A valve body shell is connected to an end of the inlet tube and encloses an upper end of a valve body assembly having an armature/needle assembly. Fuel is prevented from or allowed to discharge from the injector by moving the armature/valve assembly between valve closed and open positions. The inlet tube, valve body and valve body assembly are welded together to form a completely sealed hydraulic metering subassembly.

The power group subassembly has a coil assembly housing including a magnetic flux return path. The housing encloses a coil assembly, which generates electromagnetic forces to move the armature/needle assembly between the valve closed and open positions. The power group subassembly may comprise different shapes or types of coil assemblies depending on the particular fuel rail with which the injector is to be used, since the hydraulic metering subassembly is completely separate from the power group subassembly. However, the injector is completed when the power group subassembly is secured to the hydraulic metering subassembly so that a magnetic circuit is completed between them to operate the fuel injector.

These and other features and advantages of the invention will be more fully understood from the following detailed description of the invention taken together with the accompanying drawings.

BRIEF DESCRIPTION OF THE DRAWINGS

The accompanying drawings, which are incorporated herein and constitute part of this specification, illustrate presently preferred embodiments of the invention, and, together with a general description given above and the detailed description of the preferred embodiments given below, serve to explain the principles of the invention.

DETAILED DESCRIPTION OF THE INVENTION

Figure 1:
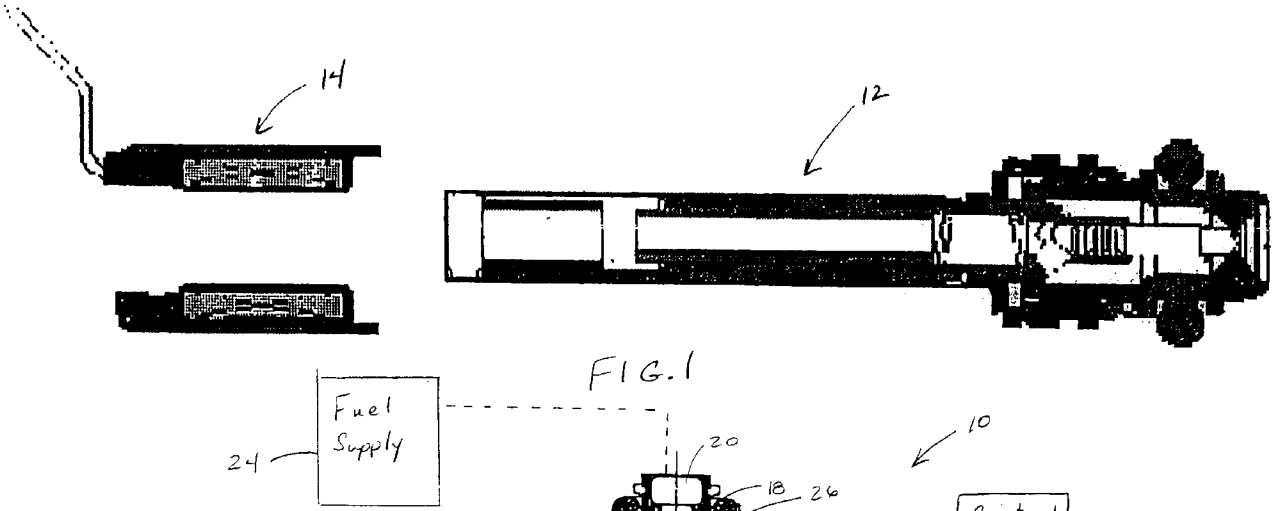
FIG. 1 is a schematic view of a fuel injector having a hydraulic subassembly and a power group subassembly constructed in accordance with the present invention.
Figure 2:
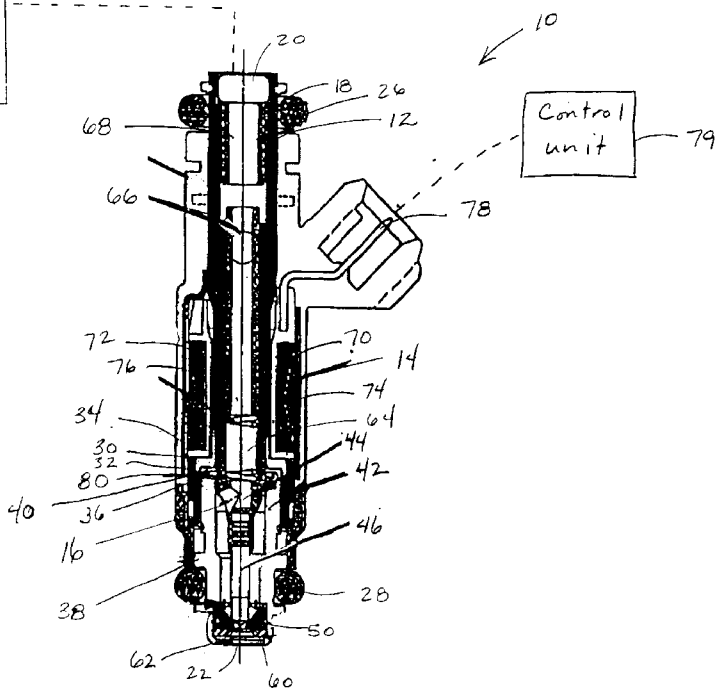
FIG. 2 is a longitudinal cross-sectional view of a fuel injector constructed in accordance with the present invention.

Referring now to FIGS. 1 and 2 of the drawings in detail, numeral 10 generally indicates a fuel injector having hydraulic metering and power group subassemblies 12,14. The hydraulic metering subassembly 12 includes a calibrated spring biased armature/needle assembly 16 movable between valve closed and open positions to meter the discharge of fuel from the injector 10. The power group subassembly 14 provides a magnetic flux return path and the electromagnetic forces that move the armature/needle assembly 16 between the valve closed and open positions. By providing an independently assembled and calibrated hydraulic metering subassembly, a variety of different types of power group subassemblies may be used resulting in a manufacturing process that is more flexible and cost efficient.

Referring to FIG. 1, the hydraulic metering subassembly 12 includes a ferromagnetic fuel inlet tube 18, which conveys fuel from a fuel inlet 20 to a fuel outlet 22. Fuel from a fuel supply 24 enters the fuel injector 10 through the fuel inlet 20, which is located at an end opposite a discharge end of the injector 10. An O-ring 26 as illustrated may be disposed around the outside of 20 fuel inlet tube 18 just below fuel inlet 20 to seal the fuel inlet 20 to a cup, or socket, in an associated fuel rail (not shown). Alternatively, other sealing arrangements, such as use of a molded fuel rail with a rubber surface, may provide the sealing. A lower O-ring 28 provides a fluid-tight seal with a port in an engine induction system (not shown) when the fuel injector is installed in an engine.

A non-magnetic shell 30 connects a valve body shell 32 to an end 34 of the inlet tube 18 opposite the fuel inlet 20. The valve body shell 32 encloses an upper end 36 of a valve body assembly 38. The valve body assembly 38 includes an upper guide eyelet 40 mounted on one end of a valve body 42 which encloses the armature/needle assembly 16. The armature/needle assembly 16 includes an armature 44 connected with a needle valve 46. Also, stacked within the valve body 42 is a lower screen 48, valve seat 50, O-ring 52, orifice disk 54 and backup retainer member 56.

The valve seat 50 is at one end 58 of the valve body 42 which includes a seating surface 60 of a frustoconical or concave shape facing the interior of the valve body 42. When the needle valve 46 is lifted off the valve seat 50, fuel is discharged from the fuel injector 10 through a central opening 62 in the valve seat 50. The needle valve 46 is normally urged against the valve seat 50 in the valve closed position by a biasing member, or spring 64, located between the armature 44 and an adjustment tube 66. The spring 64 is compressed to a desired bias force by the adjustment tube 66, which is pressed to an axial position within the fuel inlet tube 18. A fuel filter 68 is fitted into the upper end of the fuel inlet tube 18 to filter particulate matter from the fuel.

The power group subassembly 14 includes a coil assembly housing 70 enclosing a coil assembly 72. The coil assembly 72 includes a plastic bobbin 74 on which an electromagnetic coil 76 is wound. Electrical terminals 78 are connected between a control unit 79 and the coil 76 for providing energizing voltage to the coil 76 that operates the fuel injector 10. The power group subassembly 14 is secured to the hydraulic metering subassembly 12 to complete a magnetic circuit to operate the fuel injector 10.

When the coil 76 is energized, a magnetic field is developed that forms the magnetic circuit extending from the coil assembly housing 70 through the valve body shell 32 and the valve body assembly 38 to the armature 44 and from the armature 44, across a working gap 80 between the armature 44 and the inlet tube 18 and through the inlet tube 18 back to the coil assembly housing 70. A magnetic attraction is thereby created which draws the armature 44 to the inlet tube 18 against the force of the spring 64, closing the working gap 80. This movement unseats the needle valve 46 from the valve seat 50 toward the valve open position, allowing fuel to be discharged from the injector 10.

Injector 10 is made of two subassemblies 12,14 that are each first assembled and then mechanically connected together to form the injector 10. The two subassemblies, as mentioned, are a hydraulic metering subassembly 12 and a power group subassembly 14. By having two completely separate subassemblies 12,14, the hydraulic metering subassembly 12 may be calibrated with a master coil assembly, rather than with its own power group subassembly. Then, one of various forms of power group subassemblies may be added at a later time to complete the working injector 10.

Figure 6:
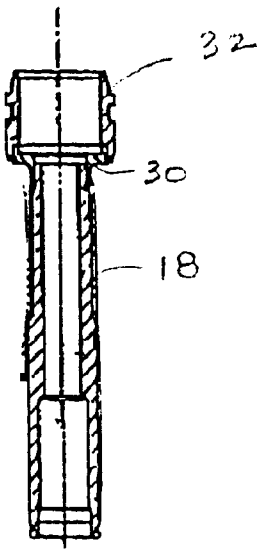
FIGS. 3–14 are respective longitudinal cross-sectional views illustrating a sequence of steps occurring during assembly of a fuel injector.
Figure 5:
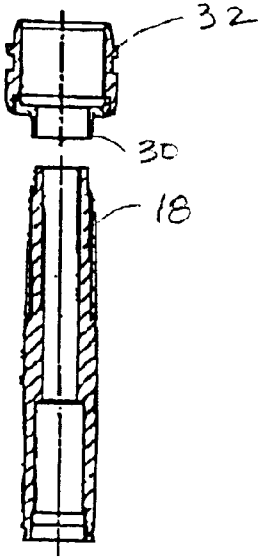
Figure 4:
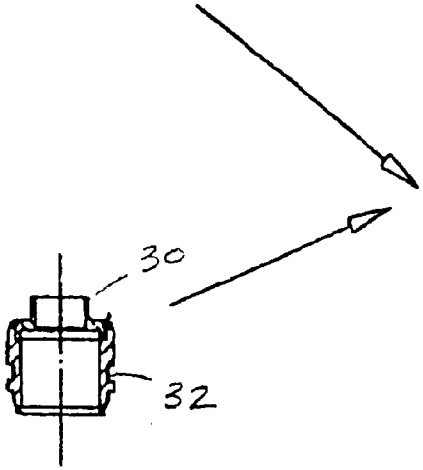
Figure 3:
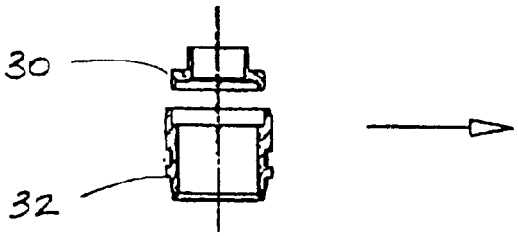

FIGS. 3–14 illustrate steps in the method of making the fuel injector of the present invention. As shown in FIGS. 3 and 4, a non-magnetic shell 30 is pressed into the valve body shell 32 and is hermetically welded to the valve body shell 32. Then, the fuel inlet tube 18 is pressed into the non-magnetic shell 30 and is hermetically welded, preferably laser welded, to the non-magnetic shell 30 as shown in FIGS. 5 and 6.

Figures 7, 8, 9, 10, 11, 12, 13, 14:
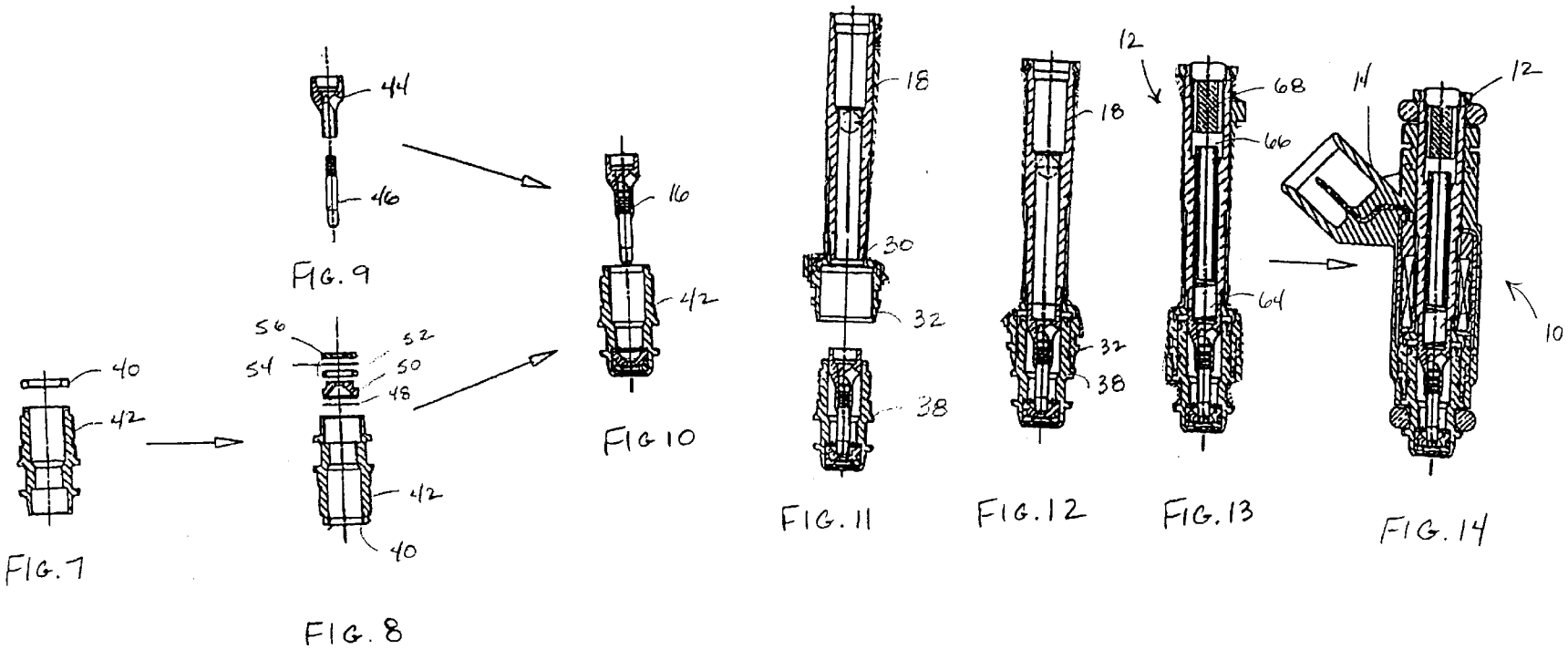

Next, as shown in FIGS. 7–10, the valve body assembly 38 is assembled by securing the upper guide eyelet 40 onto the valve body 42 by crimping it in place (FIG. 7). The lower screen 48, valve seat 50, O-ring 52, orifice disk 54 and backup retainer member 56 are loaded into the valve body 42 and then held in a desired position while the end of the valve body 42 is bent inwardly (FIG. 8). The armature 44 is connected with the needle valve 46 to form the armature/needle assembly 16 (FIG. 9) and disposed within the valve body 42 (FIG. 10).

FIGS. 11 and 12 depict the steps of inserting the valve body assembly 38 into the valve body shell 32 and welding, preferably laser welding, the valve body assembly 38 to the valve body shell 32. The adjustment tube 66 and spring 64 are installed into the inlet tube 18 as shown in FIG. 13. Then the hydraulic metering subassembly 12 is calibrated with a master coil assembly associated with a test unit by adjusting the relative positioning of the adjustment tube 66 in the inlet tube 18 to provide the correct biasing force and crimping the adjustment tube 66 in place. The fuel filter 68 is then mounted in the inlet tube 18 to complete the hydraulic subassembly 12 as shown in FIG. 13.

The power group subassembly 14 is constructed as follows. The plastic bobbin 74 is molded with the electrical terminals 78. The coil 76 is wound around the plastic bobbin 74 to form the coil assembly 72. The coil assembly 72 is placed into the coil assembly housing 70. The housing 70 and coil assembly 72 are then overmolded to complete the power group subassembly 14.

FIG. 14 depicts the step of mechanically connecting the power group subassembly 14 to the hydraulic metering subassembly 12 to complete the assembly of the fuel injector 10. The two subassemblies 12,14 are connected such that the magnetic circuit is completed between the subassemblies 12,14 to operate the fuel injector 10.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A method of making a solenoid actuated fuel injector for use with an internal combustion engine, the method comprising the steps of:

assembling a hydraulic metering subassembly having an armature/needle assembly movable between open and closed positions to meter the discharge of fuel from the injector;

calibrating the hydraulic metering subassembly using a master coil; and assembling a power group subassembly onto the calibrated hydraulic metering subassembly to complete the fuel injector.

2. A method as in claim 1 wherein the step of assembling the power group comprises the steps of:

assembling a power group subassembly including a magnetic flux return path; and assembling and welding the power group subassembly to the hydraulic metering subassembly to complete a magnetic circuit between said subassemblies to operate the fuel injector.

3. A method as in claim 2 wherein the step of assembling the power group subassembly comprises the steps of:

assembling a coil assembly; and inserting said coil assembly into a coil assembly housing having said magnetic flux return path.

4. A method as in claim 1 wherein the step of assembling the hydraulic metering subassembly comprises the steps of:

pressing a non-magnetic shell onto a valve body shell;

hermetically welding the non-magnetic shell to the valve body shell;

pressing a fuel inlet tube into the non-magnetic shell;

hermetically welding the fuel inlet tube to the non-magnetic shell;

assembling a valve body assembly;

inserting the valve body assembly into the valve body shell; and installing an adjustment tube and a biasing member into the inlet tube.

5. A method as in claim 4 wherein the step of assembling the valve body assembly comprises the steps of:

securing an upper guide member onto a valve body;

stacking a lower screen, valve seat assembly, O-ring, orifice disk and backup retainer member into the valve body;

connecting a needle valve to an armature to provide an armature/needle assembly; and disposing the armature/needle assembly into the valve body.

* * * * *